US005111220A

United States Patent [19]

Hadimioglu et al.

[11] Patent Number: 5,111,220

[45] Date of Patent: May 5, 1992

[54] FABRICATION OF INTEGRATED ACOUSTIC INK PRINTHEAD WITH LIQUID LEVEL CONTROL AND DEVICE THEREOF

[75] Inventors: Babur B. Hadimioglu, Mountain View; Butrus T. Khuri-Yakub, Palo Alto; David L. Steinmetz, Mountain View, all of Calif.

[73] Assignee: Xerox Corporation, Stamford, Conn.

[21] Appl. No.: 640,661

[22] Filed: Jan. 14, 1991

[51] Int. Cl.[5] ..... B41J 2/045

[52] U.S. Cl. ..... 346/140 R; 310/335

[58] Field of Search ..... 346/140 R, 1.1; 29/890.1, 464; 156/91, 92; 310/334-335

[56] References Cited

U.S. PATENT DOCUMENTS

| | | | |
|---|---|---|---|
| 3,723,215 | 3/1970 | Kessler | 156/92 |
| 4,454,519 | 6/1984 | Oosaka et al. | 346/140 R |
| 4,685,185 | 8/1987 | Boso et al. | 29/157 C |
| 4,751,530 | 6/1988 | Elrod et al. | 346/140 R |
| 4,801,953 | 1/1989 | Quate | 346/140 R |
| 4,959,674 | 9/1990 | Khri-Yakub et al. | 346/140 R |

FOREIGN PATENT DOCUMENTS

| | | | |
|---|---|---|---|
| 0201669 | 11/1983 | Japan | 29/890.1 |

*Primary Examiner*—Benjamin R. Fuller
*Assistant Examiner*—Victor DeVito
*Attorney, Agent, or Firm*—Townsend and Townsend

[57] ABSTRACT

A method of fabricating an acoustic ink printhead with an integrated liquid level control layer is presented. With standard photolithographic techniques, acoustic lenses and ink supply channels are defined in a substrate. Apertures are created in a spacer layer plate to define cavities to hold the ink reservoirs for each ejector. Corresponding alignment holes also made in the substrate and in the spacer layer plate. With spheres matching the size of the alignment holes, the spheres engage the alignment holes to precisely align the apertures in the spacer layer plate with the acoustic lenses in the substrate. The plate and substrate are then bonded for an integrated acoustic printhead with liquid level control by capillary action.

12 Claims, 3 Drawing Sheets

FABRICATION OF INTEGRATED ACOUSTIC INK PRINTHEAD WITH LIQUID LEVEL CONTROL AND DEVICE THEREOF

BACKGROUND OF THE INVENTION

This invention relates to acoustic ink printing and, specifically, to an improved acoustic ink printhead with an integrated liquid level control layer and method of manufacture therefor.

In acoustic ink printing, acoustic radiation by an ejector is used to eject individual droplets on demand from a free ink surface (i.e., the liquid/air interface). Typically several ejectors are arranged in a linear or two-dimensional array in a printhead. The ejectors eject droplets at a sufficient velocity in a pattern so that the ink droplets are deposited on a nearby recording medium in the shape of an image.

A droplet ejector employing a concave acoustic focusing lenses is described in U.S. Pat. No. 4,751,529, issued on Jan. 14, 1988 to S. A. Elrod et al., and assigned to the present assignee. These acoustic ink ejectors are sensitive to variations of their free ink surface levels. The size and velocity of the ink droplets which are ejected are difficult to control unless the free ink surfaces remain within the effective depth focus of their droplet ejectors. Thus the free ink surface level of such a printer should be closely controlled.

To maintain the free ink surfaces at more or less constant levels, various approaches have been proposed for acoustic ink printers. One approach is the use of a closed loop servo system for increasing and decreasing the level of the free-ink surface under the control of an error signal which is produced by comparing the output voltage levels from the upper and lower halves of a split photo-detector. The magnitude and sense of that error signal are correlated with the free ink surface level by the reflection of a laser beam off the free ink surface to symmetrically or asymmetrically illuminate the opposed halves of the photo-detector depending upon whether the free ink surface is at a pre-determined level or not. This approach is somewhat costly to implement and requires that provision be made for maintaining the laser and the split photo-detector in precise optical alignment. Moreover, it is not well-suited for use with larger ejector arrays because the surface tension of the ink tends to cause the level of the free surface to vary materially when the free surface spans a large area.

Another approach is described in U.S. Pat. application, Ser. No. 07/358,752, entitled "Perforated Membranes For Liquid Control in Acoustic Ink Printing," filed on May 30, 1989, U.S. Pat. No. 5,028,937, Butrus T. Khuri-Yakub et al., and assigned to the present assignee. In that patent application, an acoustic ink printhead has a pool of liquid ink having a free surface and intimate contact with the inner face of a perforated membrane. The perforations form large diameter apertures which are aligned with respective focused acoustic ejectors. Surface tension causes the ink menisci to extend across each of the apertures at substantially the same level. During an operation an essentially constant biased pressure is applied to the ink to maintain the menisci at a predetermined level.

However, some problems with the membrane perforation technique are difficulties associated with the misalignment of the apertures in the membrane with the acoustic ejectors, warpage of the membrane from an ideal flat surface, and variations in the distances between each aperture and corresponding ejector. Additionally, the edges of the perforations may sometimes be ragged, which can disturb the free surface of the ink so that the uniformity and quality of the ejected droplets are not consistent. Therefore alternate approaches for controlling the ink levels of the free surface for the ejectors are desirable.

The present invention is directed toward the problem of aligning the spacer layer with the substrate to create an optimally functioning integrated acoustic ink printhead with liquid level control.

SUMMARY OF THE INVENTION

The present invention provides for a method of fabricating an integrated acoustic ink printhead with liquid level control with an array of ejectors in a substrate. The method defines the locations of the ejectors in the substrate and forms a plurality of holes in the substrate at predetermined locations other than the ejector locations. Apertures are formed through a spacer layer plate with each aperture aligned with one of said ejector locations and a plurality of holes aligned with the holes in substrate are formed in the spacer layer plate. Engaging means are then placed in either the holes of the substrate or spacer layer. The complementary holes of the substrate or the spacer layer are aligned with the engagement means and the spacer layer plate is bonded to the substrate. Thus the spacer layer apertures are aligned with the substrate ejector locations.

BRIEF DESCRIPTION OF THE DRAWINGS

A clear understanding of the present invention may be achieved by perusing the following detailed Description of Specific Embodiments with reference to the following drawings.

DESCRIPTION OF THE SPECIFIC EMBODIMENT(S)

Figure 1:
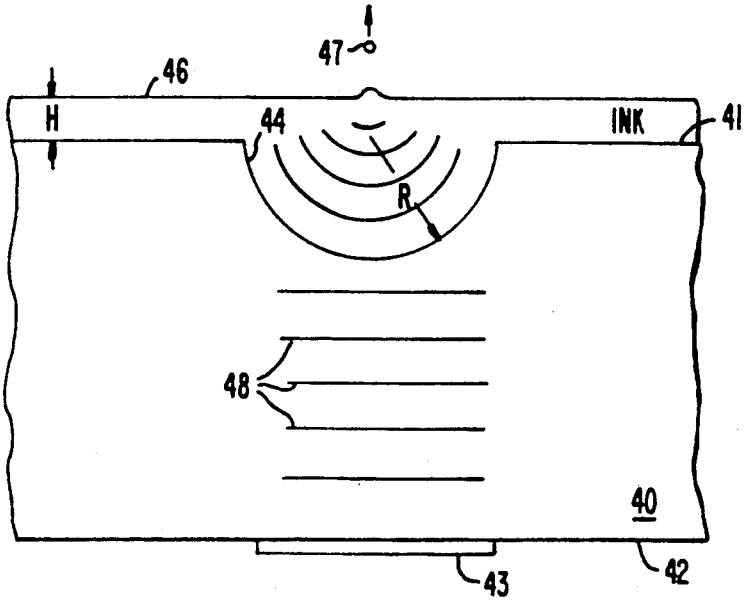
FIG. 1. PRIOR ART
FIG. 1 is a cross-sectional view of an acoustic ink ejector found in the prior art.

FIG. 1 shows an ejector of a printhead for an acoustic ink printer. It should be noted that while in all the drawings, including FIG. 1, only a single ejector is shown, typically the ejector is part of a closely spaced array, either linear or two-dimensional, in a substrate. During the printing operation, a recording medium, such as paper, is moved relative to and above the ejector array.

It should also be noted that the drawings are not necessarily drawn to scale but to facilitate an understanding of the present invention.

The ejector is formed by part of a substrate 40, a concave surface 44 on the top surface 41 of the substrate 40 and a piezoelectric transducer 43 attached to the back surface 42 of the substrate 40. The spherically concave surface 44 is the microlens described in U.S. Pat. No. 4,751,529 mentioned above. The surface 44 has a radius of curvature R centered about a point on the top surface 41 of the substrate 40.

The ejector is covered by a pool of liquid ink 45 with a free surface 46 H distance above the surface 41. Under the influence of electric pulses the piezoelectric transducer 43 generates planar acoustic waves 48 which travel in the substrate 40 toward the top surface 41. The waves 48 have a much higher acoustic velocity in the substrate 40 than in the ink 45. Typically, the ink 45 has an acoustic velocity of about 1 to 2 kilometers per second, while the substrate 40 has a velocity of 2.5 to 4 times the acoustic ink velocity. When the waves 48 reach the substrate top surface 41, they are focused at or near the free ink surface 46 by the concave surface 44. The acoustic waves 48 are concentrated as they travel through the ink 45. If sufficiently intense, the focused acoustic energy can drive a droplet of ink 47 from the surface 46 to impact a recording medium (not shown) to complete the printing process.

As described above, it is important that the level of the free surface be maintained in proper position so that the acoustic waves are focused on the surface. Otherwise, the acoustic energy is not efficiently utilized, the uniformity and velocity of the ejected droplets become varied and the print quality deteriorates.

In the present invention control of the free surface level is provided by a spacer layer plate which is bonded to the substrate according to the present invention. Aligned with the ejectors in the substrate, apertures in the spacer layer provide a space for a pool of ink for each ejector. Capillary action of the ink meniscus, the free surface, causes the free surface to maintain itself at the top surface of the spacer layer. While the apertures are small enough to maintain the level of the ink surface by capillary action, the apertures are large enough so that the focused waist diameters of the acoustic waves from the aligned ejectors below are substantially smaller than the diameters of the apertures. The apertures have no material effect upon the size or velocity of the ejected droplets.

Figure 2B:
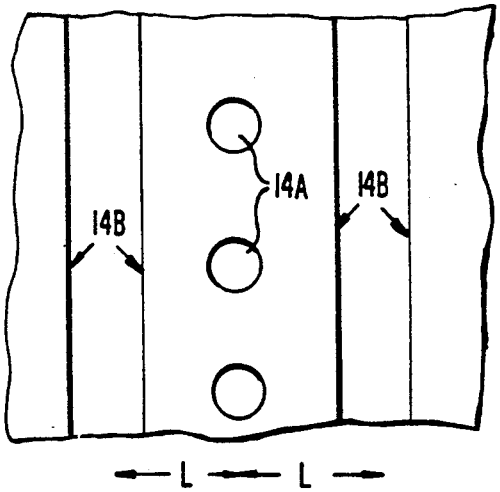
FIGS. 2–8 illustrate the various steps of manufacturing an acoustic ink printhead according to the present invention.
Figure 2A:
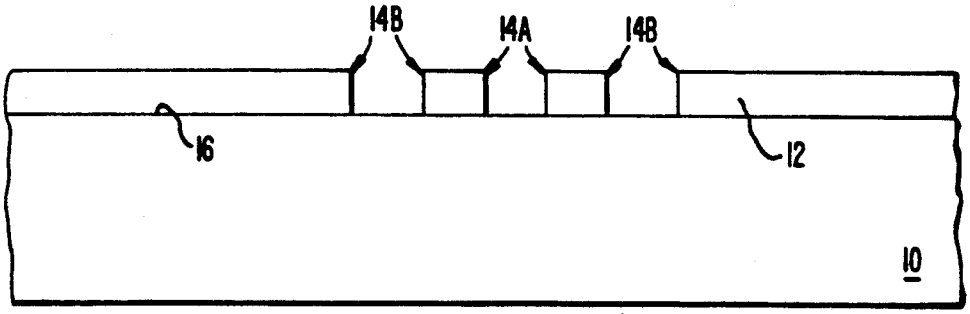

FIG. 2A illustrates an initial stage in the manufacture of an acoustic ink printhead according to the present invention. The substrate 10, which forms the base for the array of ejectors for the acoustic ink printhead, is made from a suitable material such as silicon, alumina, sapphire, fused quartz and certain glasses.

A photoresist layer 12 is deposited on the substrate 10. By well-known photolithographic techniques, apertures 14A and 14B are defined in the photoresist layer 12. The aperture 14A is used to define the acoustic lens for the ejector in the substrate 10, and the apertures 14B are used to define the ink supply channels in the substrate 10.

The aperture 14A is in the shape of circle. Because the acoustic lens of each ejector is ideally a spherically concave surface, the aperture 14A should be small so as to appear as a point source on the substrate surface 16 for an isotropic etch through the aperture 14A into the substrate 10. However, the initial aperture 14A cannot be so small that the aperture interferes with the movement of etchant and etched material through the aperture 14A during the etching operation. Thus the initial diameter of the aperture 14A should be approximately 25 microns.

The apertures 14B are the etching aperture masks for the ink supply channels in the substrate 10. FIG. 2B is a top view of this stage of the manufacture. As can be seen from the drawing, each circular aperture 14A is part of a linear array with the parallel apertures 14B for the ink supply channels for the ejectors in the substrate 10. The apertures 14B for the ink supply channels are spaced 2L apart with the apertures 14A centered between. The parameter L, approximately 250 microns, is chosen such that upon the completion of the etching for the ink supply channels and acoustic lenses in the substrate 10, the ink supply channels and acoustic lenses are connected.

Figure 3:
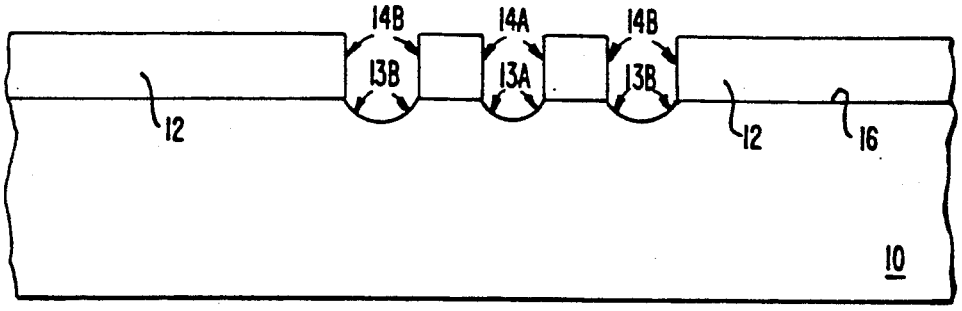

Thus with the apertures 14A and 14B, the substrate 10 is etched to define the acoustic lens for the ejector and the ink supply channels in the substrate 10. As shown in FIG. 3, a cavity 13A shows the beginning of the concave surface for the acoustic lens of the ejector and cavities 13B show the beginnings of the ink supply channels in the substrate 10.

Figure 4:
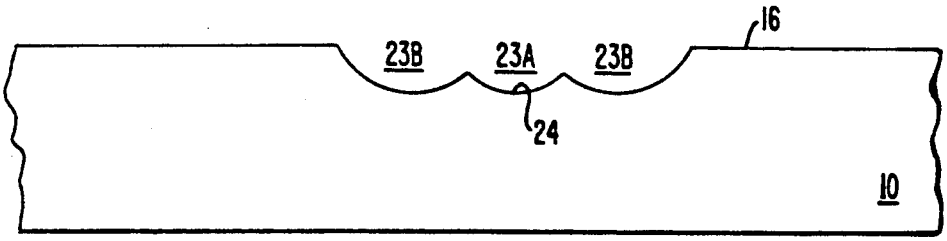

FIG. 4 shows the completed substrate 10 with the photoresist layer 12 removed. A center cavity 23A has a concave surface 24 which forms the acoustic lens for the ejector. The flanking cavities 23B form the ink supply channels for the ejectors, including the ejector shown. The etching of the substrate 10 through the apertures 14A and 14B in the spacer layer 11 is performed long enough so that the originally separated cavities 13A and 13B merge into the connected cavities 23A and 23B.

Figure 5:
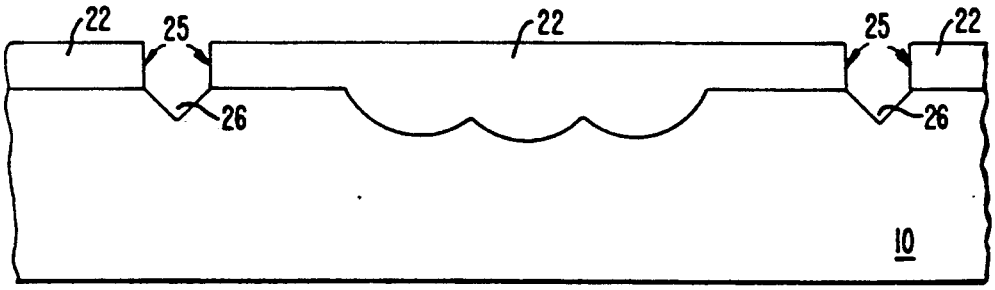

FIG. 5 illustrates the step of forming alignment holes in the substrate 10. The top surface of substrate 10 is covered with another photoresist layer 22. With an alignment mask, alignment apertures 25 are created in the photoresist layer 22. Then with the use of an anisotropic etch, polyhedral alignment holes 26 are created in the substrate 10. For example, if the substrate 10 is silicon with [100] crystal orientation, an anisotropic silicon etch may be used to create an angular cavity in the shape of an inverted four-sided pyramid. Potassium hydroxide is typically used as the anisotropic etchant for [100] silicon. The anisotropic etch ensures that the size of the alignment holes 26 are controlled; the size of the holes 26 are set by the size of the mask apertures 25.

Together with the substrate 10, a spacer layer plate 11 is also fabricated. The spacer layer plate 11 may made of a material, such as silicon, amorphous silicon or glass. The present invention allows the plate material to be selected independently of the material of the substrate so that the plate material may be the same as, or different from, the substrate material, as operating or fabrication factors are considered.

However, as explained below, [100] silicon is preferable for the alignment holes in the plate 11. Another advantage of the selection of [100] silicon for the spacer layer plate 11 is that it has the same coefficient of expansion as the [100] silicon substrate. There is a greater certainty of success in high-temperature fabrication steps, such as the bonding of the piezoelectric transducers of the printhead substrate, with the substrate and spacer layer plate matched.

The spacer layer plate 11 has a thickness H, $$H=R[1/(1-V_{ink}/V_{subs})-1[$$

where R typically 150 microns, is the radius of the spherically concave lens to be formed in the substrate 10 and $V_{ink}$ and $V_{subs}$ are the acoustic velocities in ink and substrate respectively. The thickness H, typically 35 microns, of the plate 11 is such that the acoustic waves are focused H distance from the top surface 16 of the substrate 11. Stated differently, the thickness of the spacer layer plate is such the distance from acoustic lens to the top of said spacer layer bonded to said substrate is approximately equal to the acoustic focal length of the lens. During operation of the acoustic printhead, the free surface of the ink is maintained at the top of spacer layer.

Figure 6:
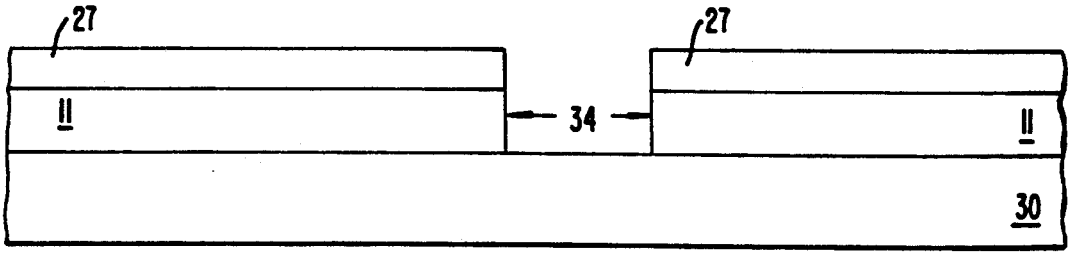

As illustrated by FIG. 6, the spacer plate 11 is placed on a support plate 30 and covered by a photoresist layer 27. With standard photolithography and etching, apertures 34 corresponding to the locations of the apertures 14A in the photoresist layer. 12 for the substrate 10 are created in the photoresist layer. 27 and spacer layer plate 11. The aperture 34 is much larger, however, than the aperture 14A which has only 25% the diameter of the aperture 34. The full-sized aperture 34 forms the edge around the free surface of the ink reservoir for each ejector and its acoustic lens surface 24.

The photoresist layer 27 which was used to define the aperture 34 is then removed and a new photoresist layer 30 is deposited on the spacer layer plate 11. Again with standard photolithography, apertures 29 are created in the photoresist layer 30. The apertures 29 correspond to the apertures 25 in the photoresist layer 22 used to created the alignment holes 26 in the substrate 10. In fact, the same mask for the alignment apertures 25 may be used for the apertures 29.

Figure 7:
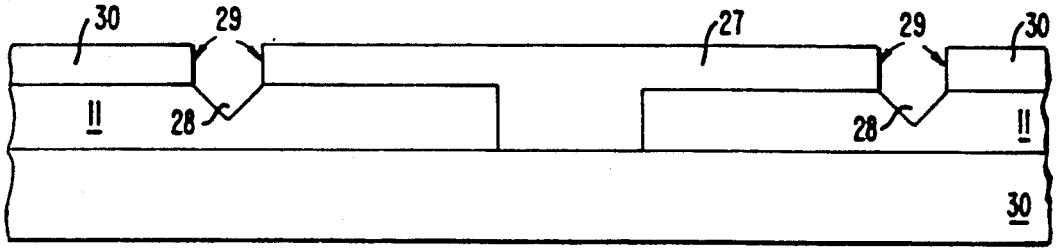

Then the spacer layer plate 11 is anisotropically etched with the photoresist layer and the apertures 29 as a mask to create alignment holes. As shown in FIG. 7, material of the plate 11 is selected to be [100] silicon and the same anisotropic etchant used for the substrate 10 is used to create the four-sided inverted pyramid-shaped alignment holes 28 in the plate 11. With the alignment apertures 25 being the same size as the alignment apertures 29, the alignment holes 26 in the substrate 10 are the same size as the alignment holes 28 in the plate 11.

Then spheres 32 of material, such as ceramic or steel ball bearings, are placed into the alignment holes 26 of the substrate 10 and the spacer layer plate 11 is fitted over the substrate 10 and the spheres 32. The diameters of the spheres 32 are matched to the size of the alignment holes 26 and 28. Of course, the apertures 28 of the spacer plate 11 could receive the spheres 32 first and the substrate 10 fitted over the plate 11 and spheres 32. When the alignment holes 26 in the substrate 10 are aligned with the alignment holes 28 in the plate 11, the spheres 32 engage both sets of alignment holes 26 and 28 and the substrate 10 is aligned precisely with the spacer layer plate 11. At this point the substrate 10 and the spacer layer 11 are bonded together to form an integrated printhead with liquid level control.

Figure 8:
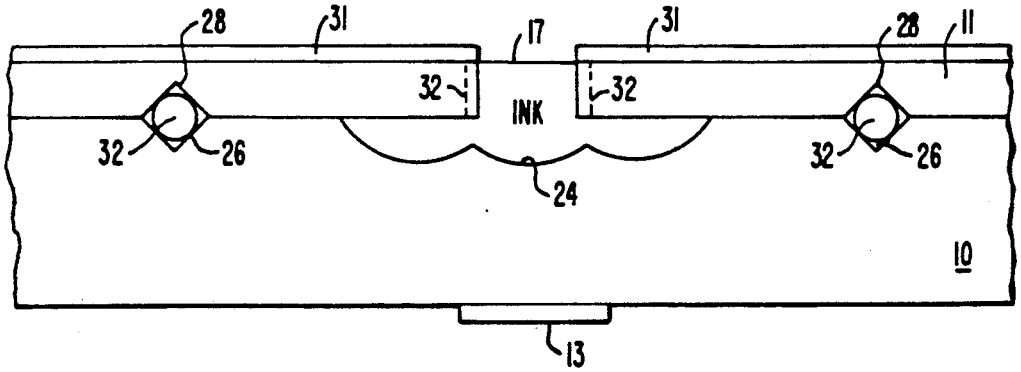

A partial view of the completed ejector is shown in FIG. 8. Ink fills the ejector cavity 23A and ink supply channels 23B. The ink has a free surface 17 over the concave surface 24 of the acoustic lens which is driven by a piezoelectric crystal 13 aligned directly below the surface 24 and fixed to the bottom of the substrate 10.

A refinement over the control of the free surface of the ink is possible by the addition of an optional layer 31 deposited over the spacer layer plate 11. This material, which may be silicon nitride, silicon dioxide or other materials, is deposited by conventional techniques, such as sputtering, evaporation and chemical vapor deposition. The material should be different from the material of the spacer layer plate 11. Ideally the optional layer 31 should be more hydrophobic than the spacer layer plate 11. Note the word "hydrophobic" is used here with the presumption that the ink is water-based. "Hydrophobic" also includes the meaning of ink-repellant in the more general sense.

The material of the layer 31 gathers around the edge of the opening 34 in the spacer layer plate 11. The optional layer 31 maintains the ink surface at the top surface height of the spacer layer 27. Being hydrophobic the layer 31 helps keep the top of the layer 31 from becoming wet and thereby drawing the ink surface up to a new level and out of focus depth of the acoustic beam. The greater hydrophobicity of the layer 31 compared to that of the plate 11 increases the effect of the capillary action upon the ink meniscus, the free surface, to maintain itself at the same level, the top surface of the plate 11.

As a further refinement the spacer layer plate 11 may be cut back as shown by the dotted lines 32 in FIG. 8 by an etchant specific to the spacer layer plate material. This is possible if the material of the spacer layer plate 11 is different from that of the substrate 10.

While the above is a complete description of the preferred embodiments of the invention, various alternatives, modifications and equivalents may be used. For example, with appropriate changes some of the fabrication steps may be reversed in order. Furthermore, exemplary dimensions and parameters have been disclosed, but other dimensions and parameters may be used for particular operational characteristics as desired. Therefore, the above description should not be taken as limiting the scope of the invention which is defined by the appended claims.

What is claimed is:

1. An integrated acoustic ink printhead with liquid level control comprising a substrate having an array of ejectors, each of said ejectors having a concave substrate surface area with a radius of curvature capable of radiating a free surface of ink with focused acoustic radiation to eject individual droplets of ink on demand, each of said ejectors having an acoustic focal length approximately equal to each other;

a spacer layer with a first surface in intimate contact with said substrate and a second surface opposite said first surface, said spacer layer having a predetermined thickness approximately equal to a difference between each of said ejectors acoustic focal length and each of said ejectors radius of curvature, said spacer layer also having a set of apertures through said spacer layer, each aperture aligned with one of said ejectors substrate surface area;

a set of holes in said spacer layer first surface and a set of corresponding holes in said substrate, said spacer layer holes and said substrate holes forming cavities at the contact between said spacer layer and said substrate in locations other than said apertures in said spacer layer and said substrate; and means in said cavities for engaging said spacer layer and said substrate;

whereby said set of apertures is aligned with each of said ejectors substrate surface area and said set of apertures in said spacer layer form a control for a level of said free ink surface above each of said ejectors substrate surface area.

2. The integrated acoustic printhead of claim 1 wherein said spacer layer has edges around said apertures, and further comprising a layer of hydrophobic material on said second surface of said spacer layer extending around the edges of said apertures.

3. The integrated acoustic printhead of claim 2 wherein said layer of hydrophobic material has a higher degree of hydrophobicity than said spacer layer.

4. The integrated acoustic printhead of claim 3 wherein said layer of hydrophobic material extends around and over said edges of said apertures.

5. The integrated acoustic printhead as in claim 1 wherein said substrate surface area for each ejector is spherically concave with substantially a radius of curvature R and wherein said spacer layer has a thickness H, where $$H = R(1/(1 - V_{ink}/V_{subs}) - 1)$$

and $V_{ink}$ and $V_{subs}$ are acoustic velocities in said ink and substrate respectively.

6. The integrated acoustic printhead as in claim 1 wherein said cavities are polyhedral.

7. The integrated acoustic printhead as in claim 6 wherein said substrate and said spacer layer comprise silicon having a (100) crystal orientation.

8. The integrated acoustic printhead as in claim 1 wherein said engaging means comprises objects having a shape corresponding to said substrate and spacer layer holes.

9. The integrated acoustic printhead as in claim 1 wherein said engaging means are spherically shaped.

10. The integrated acoustic printhead as in claim 9 wherein said engaging means have diameters corresponding to said substrate and spacer layer holes.

11. The integrated acoustic printhead as in claim 10 wherein said engaging means comprise steel ball bearings.

12. The integrated acoustic printhead as in claim 10 wherein said engaging means comprise ceramic ball bearings.

* * * * *